US005218910A

United States Patent [19]

Mesmer et al.

[11] Patent Number: 5,218,910

[45] Date of Patent: Jun. 15, 1993

[54] ROLLER COASTER WITH PHEUMATIC CONFORMING SEATS AND PRONE PASSENGER ARRANGEMENT TO ENHANCE THE THRILL OF THE RIDE

[76] Inventors: Ethan J. Mesmer, 4582 Roxbury Cir., Batavia, Ohio 45140; Matthew S. Gray, 965 View Dr., Cincinnati, Ohio 45245; Milton E. Parrish, 587 Ibold Rd., Loveland, Ohio 45140

[21] Appl. No.: 868,999

[22] Filed: Apr. 15, 1992

Related U.S. Application Data

[63] Continuation-in-part of Ser. No. 746,211, Aug. 15, 1991, abandoned, which is a continuation of Ser. No. 529,472, May 29, 1990, abandoned.

[51] Int. Cl.[5] ..... A63G 31/04

[52] U.S. Cl. ..... 104/63; 104/57; 104/121; 105/344; 105/346

[58] Field of Search ..... 104/53, 56, 57, 63, 104/64, 76, 121, 241; 105/344, 345, 346, 147; 296/63; 297/456, 457, 284 R, DIG. 3

[56] References Cited

U.S. PATENT DOCUMENTS

| | | | |
|---|---|---|---|
| 810,646 | 1/1906 | Harris | 105/344 |
| 827,313 | 7/1906 | Lauster et al. | 104/56 |
| 832,319 | 10/1906 | Humphrey | 105/147 |
| 1,380,732 | 6/1921 | Miller | 104/53 X |
| 2,128,492 | 8/1938 | Mena | 104/56 |
| 3,205,009 | 9/1965 | Heride et al. | 297/456 X |
| 3,608,961 | 9/1971 | Von Heck | 297/284 R |
| 3,762,404 | 10/1973 | Sakita | 128/89 R |
| 3,885,503 | 5/1975 | Barber | 104/53 X |
| 4,195,576 | 4/1980 | Gutridge | 104/121 X |
| 4,213,213 | 7/1980 | Burnett | 297/284 R |
| 4,221,170 | 9/1980 | Koudelka | 104/63 |
| 4,724,771 | 10/1988 | Yamada | 104/56 |

FOREIGN PATENT DOCUMENTS

| | | | |
|---|---|---|---|
| 3901140 | 7/1990 | Fed. Rep. of Germany | 105/345 |

*Primary Examiner*—Robert J. Oberleitner
*Assistant Examiner*—S. Joseph Morano
*Attorney, Agent, or Firm*—Wood, Herron & Evans

[57] ABSTRACT

A roller coaster has cars with passenger supports to hold the passengers in a substantially horizontal position within the car during the ride in seats which can be rigidly molded for each new individual passenger to conform to the unique body contours of the passenger, wherein the cars have multiple vertically-tiered levels of passenger support and are supported from above and below on the track, to provide an increased speed and thrill capability for the ride.

15 Claims, 5 Drawing Sheets

ROLLER COASTER WITH PHEUMATIC CONFORMING SEATS AND PRONE PASSENGER ARRANGEMENT TO ENHANCE THE THRILL OF THE RIDE

BACKGROUND OF THE INVENTION

This is a continuation-in-part of application Ser. No. 07/746,211, filed Aug. 15, 1991, which is a file wrapper continuation of application Ser. No. 07/529,472, filed May 29, 1990, now abandoned.

This invention relates to an improved roller coaster and roller coaster car.

A roller coaster in its basic form consists of a track section having curves and hills and valleys and a series of cars mounted on the tracks. The first section of the roller coaster is a power section having a chain drive that carries the series of cars upward to the highest point on the track section and then releases the cars, travel under the force of gravity through the exciting hills, valleys and curves.

Over the past 100 years or so, there have been modifications to the original roller coaster. The wooden trestle supporting the track has been changed to steel. Safety harnesses have been provided. The car has been suspended below a track. In one version, the ride is such that a rider can stand on the car.

SUMMARY OF THE INVENTION

An objective of the present invention has been to provide new concepts in the roller coaster construction that create new sensations and thrills heretofore not experienced in a roller coaster while maintaining the safety of the passengers.

The objective of the invention has been attained in part by providing a track section which, after the power section, has a long, purely vertical run to generate a speed of about 100 miles per hour. The free fall is about 300 feet. Because it is a vertical fall, there is substantially no friction and no sensation of riding on a track during the fall. The frictionless fall enables the car to achieve a speed of approximately 100 miles per hour and imparts to the rider the sensation of uncontrolled drop that is a new and thrilling sensation not heretofore experienced in roller coasters.

The objective of the invention is further attained by placing the passenger in a position that is substantially parallel to the plane of the axis of the car and thus substantially horizontal when the car is in a horizontal attitude.

The objective of the invention is further attained by providing, in the car, a contoured head-to-heel support for the passenger, and preferably one whose contour can be changed to precisely match that of any occupant ensconced in the car.

Another objective of the invention has been to provide compact multiple passenger support that allows more passengers to be securely mounted in a car than has been heretofore possible.

This objective of the invention has been attained by providing a two-tiered staggered passenger support that permits four passengers to ride compactly in one car.

BRIEF DESCRIPTION OF THE DRAWINGS

The several features of the invention will become more readily apparent from the following detailed description taken in conjunction with the accompanying drawings in which.

DETAILED DESCRIPTION OF THE INVENTION

Figure 1:
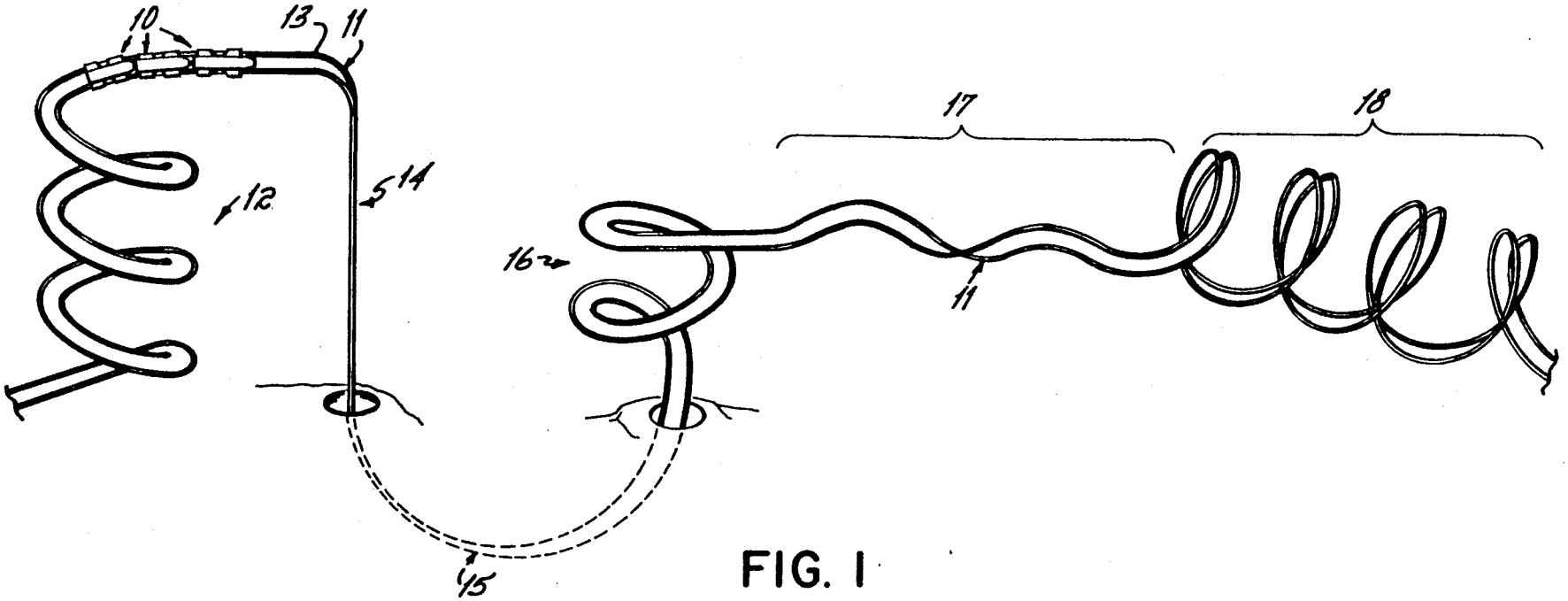
FIG. 1 is a schematic view of the roller coaster drawn in a develop fashion.

Referring to FIG. 1, the roller coaster is formed by a series of cars 10 mounted on an endless track 11. The track 11 has a power section 12 wherein the cars are carried to the peak 13 of the roller coaster. Following the peak 13, the track has a vertical section 14 of about 200 to 300 feet, preferably 300 feet. The track then passes underground in a U-shaped section 15 that penetrates into the ground to a depth of about 50 feet. Next, the track defines a helical section 16. Beyond the helical section is a wipe section 17 wherein the car swings back and forth to the left and right while swinging up to a 90° orientation on each side. The next section depicted is the most complex section which is the rolling helical section 18. There, the car rolls about its longitudinal axis, thereby defining a tight helix. The longitudinal axis at the same time follows a larger helical path. The relationship of the car and the human body to the track admit of other thrilling maneuvers. Finally, in the last section of track, a car is returned to the lower portion of the power section ready to begin a new excursion. The securement, position, and thrill of the passenger as he rides through the torturous helical, vertical and loop sections of the coaster track are important aspects of this invention.

Figure 2:
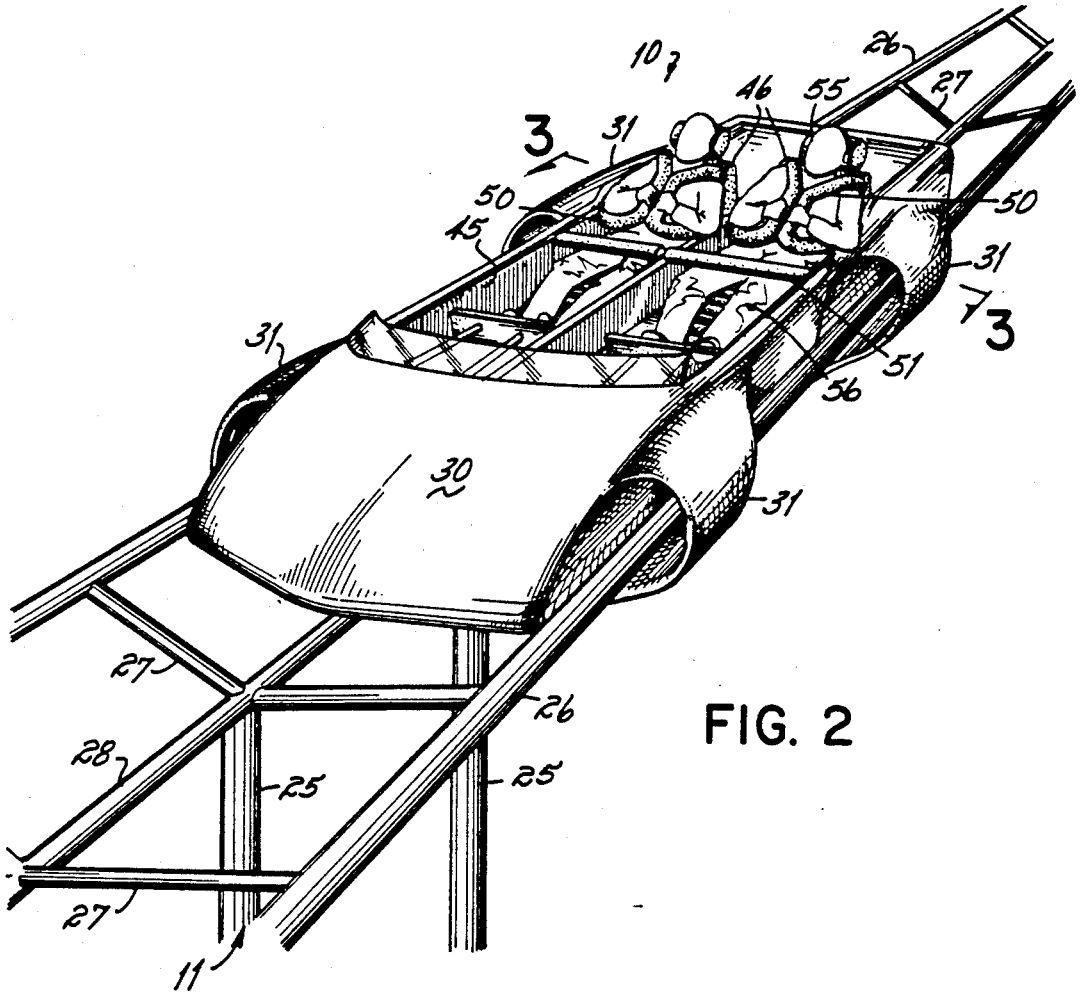
FIG. 2 is a perspective view of one roller coaster car on a section of track.

An exemplary car 10 and track are depicted in FIG. 2. The track 11 is supported on vertical trestle sections 25 whose construction is well known. The track has two rails 26 that are supported by transverse tubes 27 oriented in a shallow V-shaped configuration. At the apex of the V, a longitudinal tube 28 is joined integrally to the transverse tubes 27.

Each car 10 has a streamlined body 30 having wraparound sections 31 fore and aft to conceal the wall structure by which the car is mounted to the rails.

Figure 3:
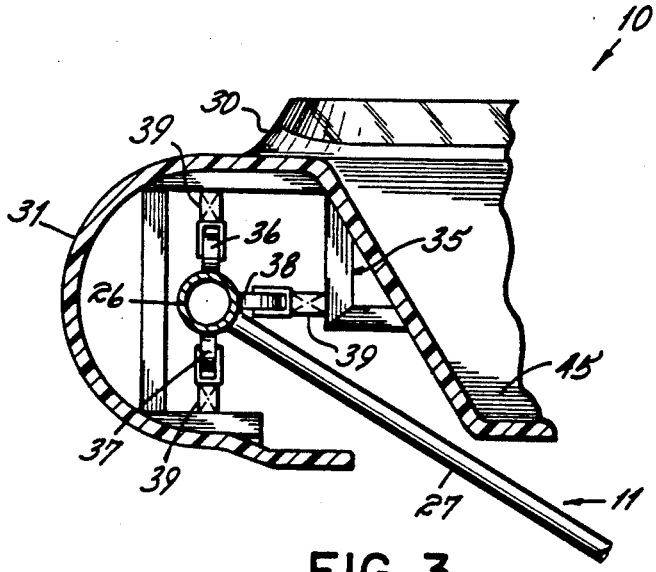
FIG. 3 is a cross-sectional view taken along lines 3—3 of FIG. 2.

The suspension system is illustrated in FIG. 3. The car has a rugged metal chassis 35. Mounted on the chassis are upper wheels 36, lower wheels 37 and inside wheels 38. Each wheel seat is supported by a shock absorbing suspension 39 to assure a smooth ride. Similar wheel sets connect the car to the rails 26 fore and aft of the car and on each side of the car.

The car body has a deep well 45 into which the body supports 46 are mounted. In the illustrated form of the invention, each car has supports 46 for two persons side-by-side. It is preferable that the well 45 be deep enough so that when the body supports are mounted in the car, the combined mass of the car and body supports has a center of gravity that is below the plane of the rails 26 when the rails are in a horizontal attitude. The deep well configuration is permitted by the V construction formed by the transverse members 27 which support the rails 26.

Figure 4:
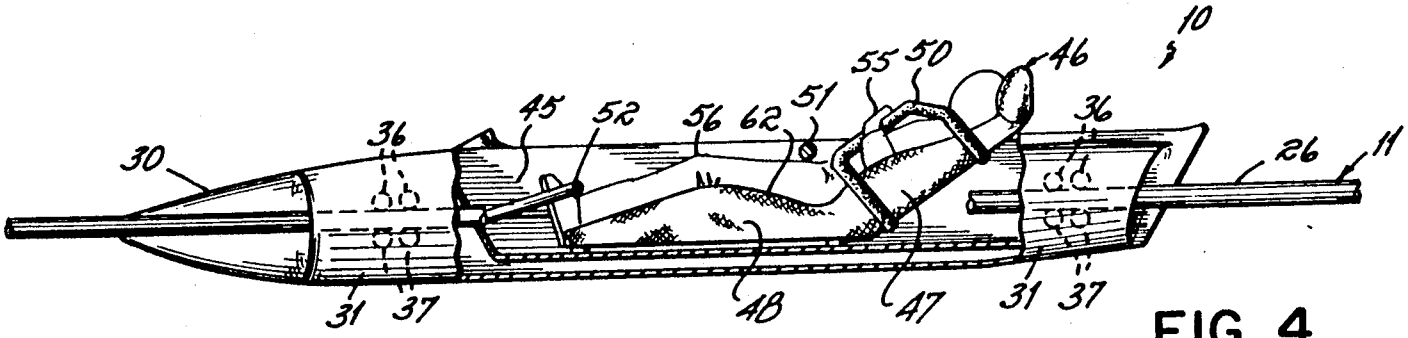
FIG. 4 is a longitudinal side elevational view with the car body broken away to illustrate the position of the body support and occupant.
Figure 5:
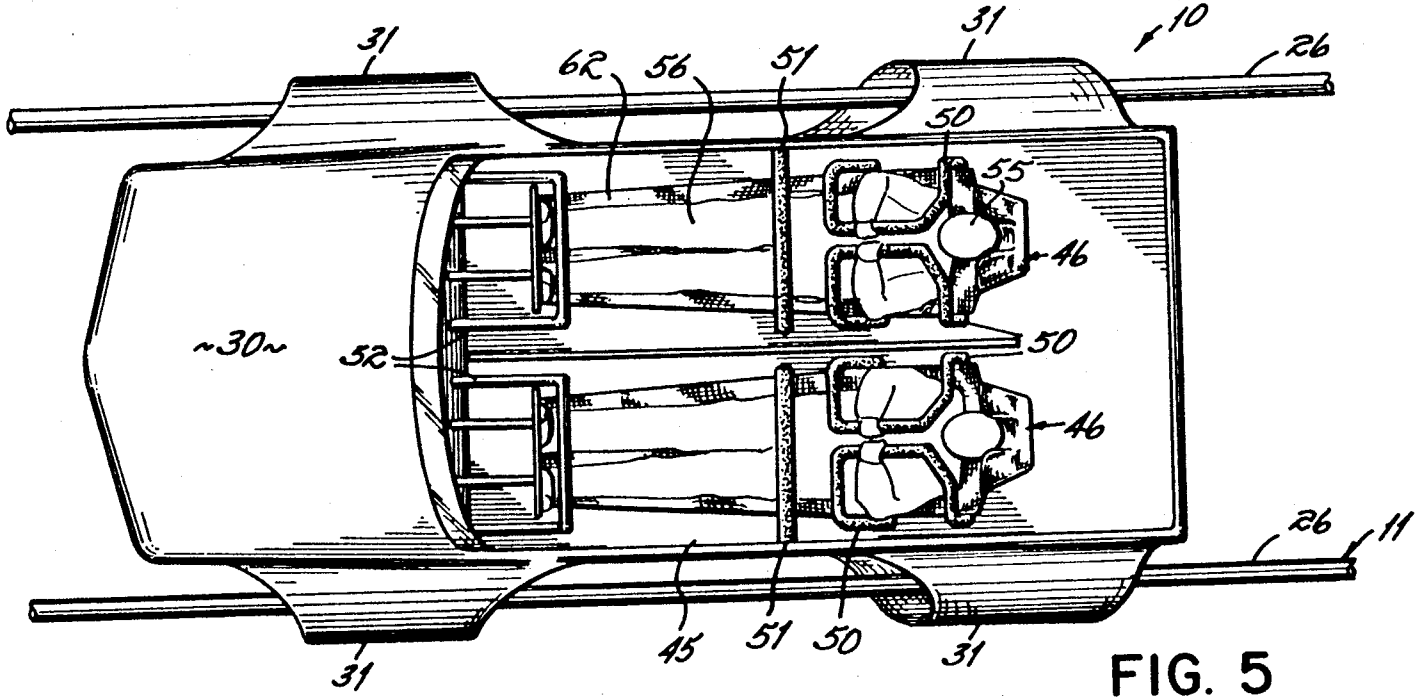
FIG. 5 is a top plan view of the car of FIG. 4.

Within each car are restraints designed to keep the human body 55 on the support 46. Foremost among the restraints are a pair of U-shaped restraints 50 that lie across the shoulders, chest and stomach of the occupant as shown in FIGS. 4 and 5. A transverse thigh restraint 51 lies across the thighs of the occupant and a U-shaped ankle restraint 52 lies across the ankles of the occupant 55.

Figure 6:
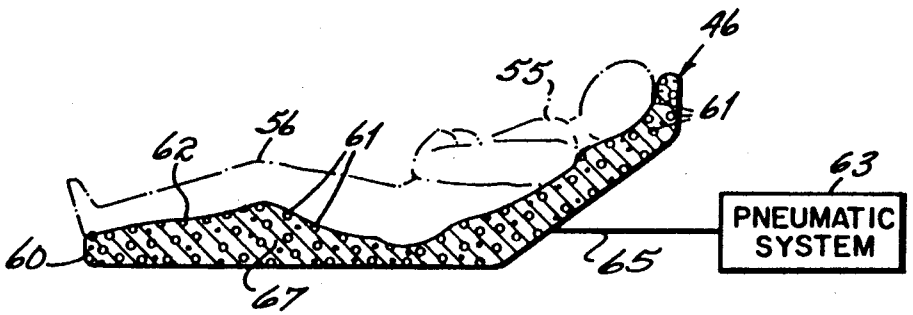
FIG. 6 is a diagrammatic cross-sectional view of the body support.

As best shown in FIG. 6, each body support 46 is contoured to fit, as nearly as possible, the exact contour of the passenger body 55 from head to heel. It is important that the body support 46, with respect to the car and rails, maintains the body 55 substantially parallel to the rails or in a substantially horizontal position when the rails are horizontal. To this end, the body support 46 has an upper torso section 47 and a lower torso section 48. The upper body of the passenger in the upper torso section 47 is preferably inclined at an angle between 20°-35°, although an angle of up to about 45° could be employed. The lower body is maintained essentially parallel track 11 by lower torso section 48. Further, preferably the legs are bent slightly at the knees 56 as shown in FIG. 6. The substantially lying down position of passenger 55 during the ride cycle increases the thrill of the ride for the passenger.

The body support 46 may be molded to the contour of the passenger's body 55 by providing an airtight, pneumatically-supported sheet as the surface upon which the passenger 55 lies. Preferably, however, the body support will be formed as a sort of bean bag chaise 60. Such a support can incorporate the concepts disclosed in U.S. Pat. No. 3,762,404 which is incorporated herein by reference. The bean bag chaise 60 will consist of small freely moving particles 61 of material, for example, polystyrene foam pellets, which are encased in a fabric case 62 and which move around freely while there is air within case 62. The bean bag chaise 60 may be divided into a plurality of compartments such as are depicted in U.S. Pat. No. 3,762,404. A pneumatic system 63, such as a vacuum system, is preferably provided to evacuate air from the inner compartment 67 of chaise 60 to immobilize the particles 61 and provide a substantially rigid support for the passenger's body 55 after the occupant has assumed his position in the ride.

In operation, when the chaise 60 is in an unevacuated condition and the passenger sits down within chaise 60, freely moving particles 61 conform the fabric case 62 to every major contour of the passenger's body 55. When the body 55 is fully reclined, the pneumatic or vacuum system 63 is engaged and chaise 60 is evacuated of air causing chaise 60 to maintain its pre-evacuation shape (which shape follows the contours of the passenger's body 55) to provide a rigid, individually conformed seat support for the passenger. The fabric case 62 of chaise 60 can be formed to laterally extend on the sides of the passenger body so as to provide both upward and lateral support simultaneously for the passenger during the ride (see FIG. 7). The shoulder and leg restraints, 50, 51 and 52, are then applied and the passenger is ready to start the ride cycle.

Preferably, the pneumatic system 63 per se is located at the passenger loading zone and is connected through air hoses 65 and couplings (not shown) to the respective cars and supports for air evacuation after the passenger's bodies 55 are in a prone position within the cars 10. Thereafter, pneumatic system 63 is disengaged by sealing case 62 and its respective couplings (not shown) and hose 65. Chaise 60 then remains rigid and true to the preevacuation passenger contour form throughout the duration of the ride. When the cars return to the passenger loading zone at the end of the ride cycle, the couplings (not shown) connected to case 62 are opened so as to allow air to re-enter inner compartment 67. The pressure in inner compartment 67 equalizes with the outside atmospheric pressure so that the beads 61 again move freely around each other, and the chaise 60 is ready to accept the next passenger.

Figure 7:
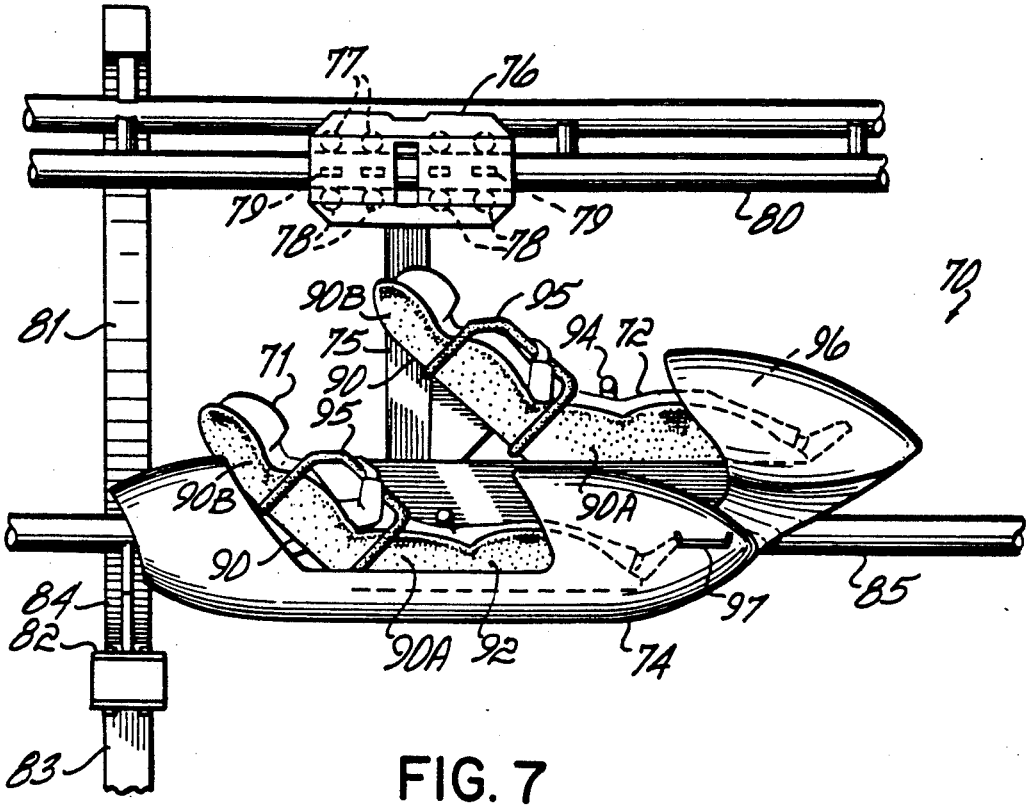
FIG. 7 is a side elevational view partly in section of an alternative embodiment.
Figure 9:
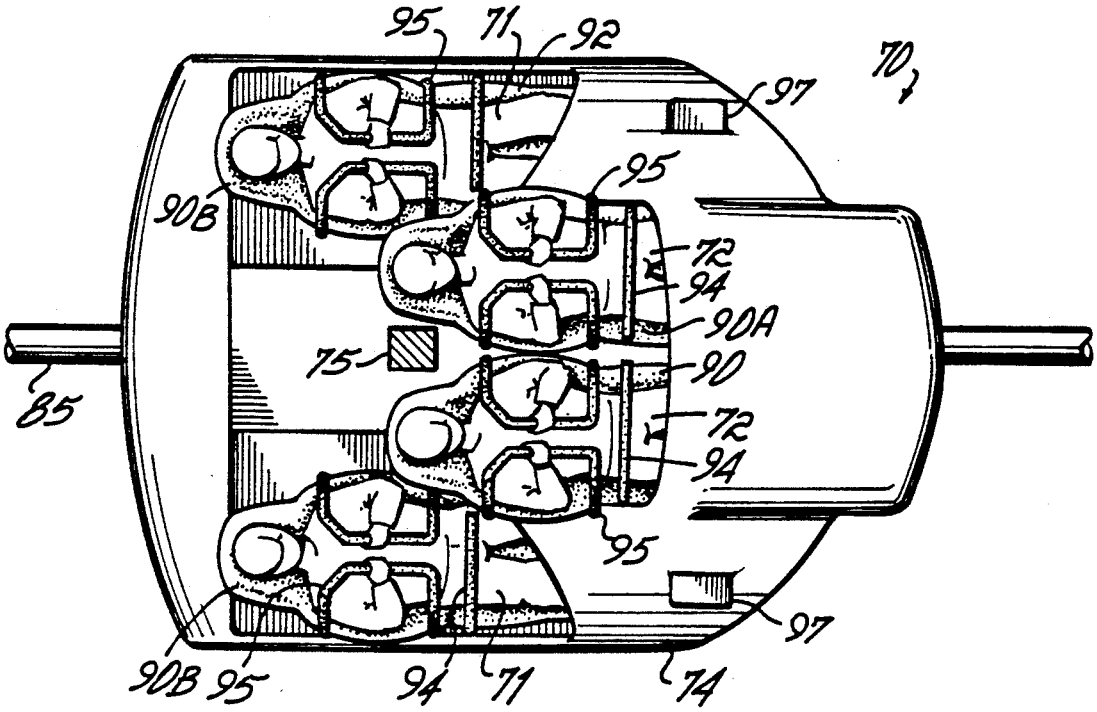
FIG. 9 is a top plan view partly in cross-section of the alternative embodiment.
Figure 8:
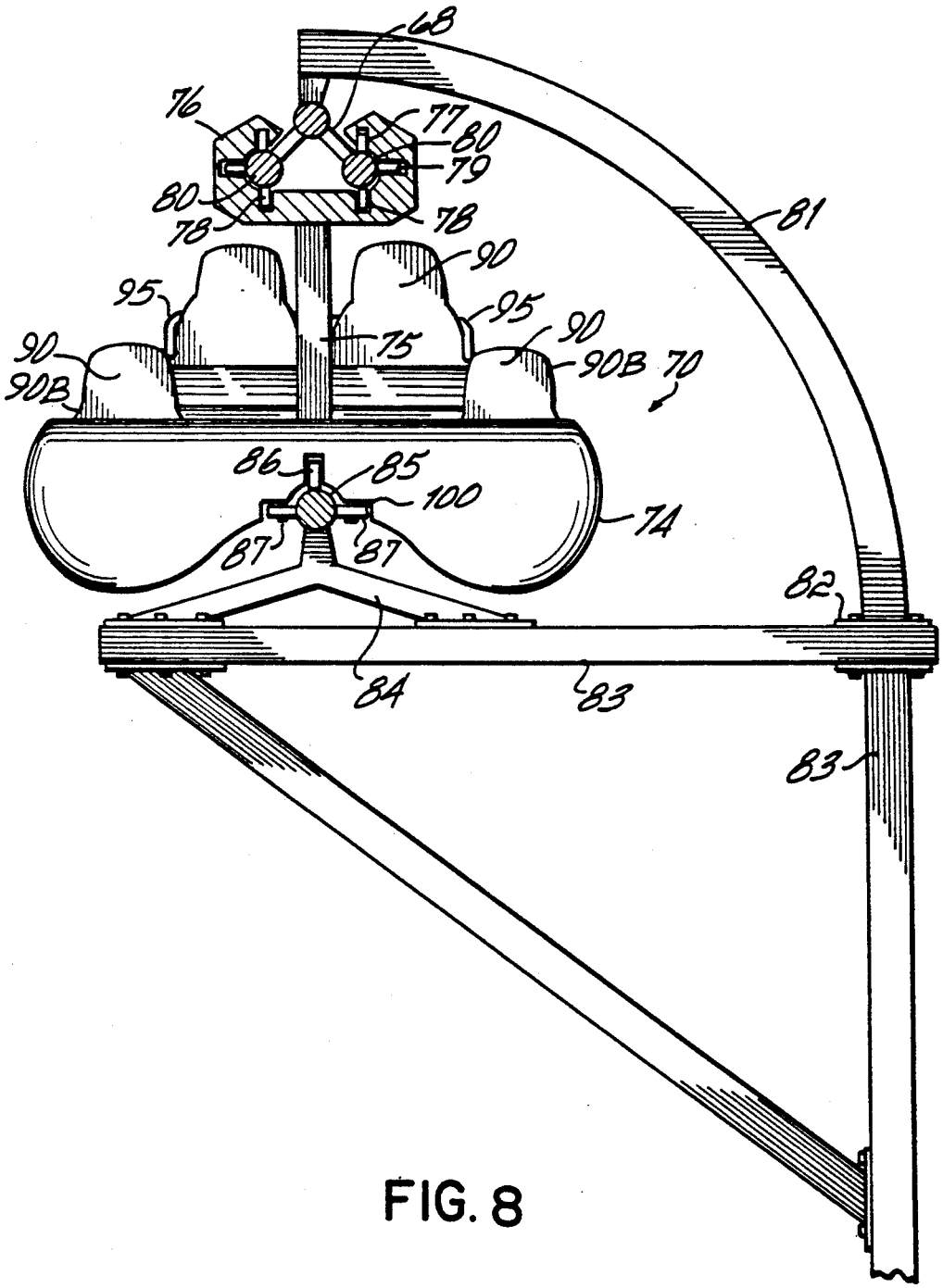
FIG. 8 is a rear end elevational view of the alternative embodiment.

An alternative embodiment of the passenger support is shown in FIGS. 7, 8 and 9. As best shown in FIG. 7, a car 70 is provided with multiple tiers of support to support multiple passengers in a vertically-tiered relationship within a single car. Preferably there are two tiers of support to secure two or more passengers 71 reclining at a lower level and two or more passengers 72 reclining at an upper level, although more than two tiers may be used within the car 70. The car 70 has a rigid chassis 74 which is fixed to a vertical post 75. The upper end of the post 75 has a U-shaped receptacle 76. Each side of the receptacle carries upper rollers 77, lower rollers 78 and side rollers 79. On each side of the receptacle those rollers engage a circular cross section rail 80. The two rails 80 are at the lower end of an inverted V-shaped rail structure. The V-shaped rail structure 68 is supported on an arcuate post 81 which is in turn bolted at its lower end 82 to a trestle-type support 83. The trestle-type support 83 also carries a single rail mounting bracket 84 which has a circular cross section rail 85. The rail is engaged by upper rollers 86 and side rollers 87 that are rotatably mounted within channel 100, integrally formed in the bottom of chassis 74.

Referring to FIG. 7, the chassis 74 has a contoured, rigid body support 90 at each of the four positions for supporting a passenger. The rigid body support 90 is U-shaped in cross section, thereby providing lateral support as well as vertical support for the passenger. Longitudinally, each support has a horizontal section 90A to receive hips and legs of the passenger and a section 90B inclined to receive the chest and head of the passenger. The chest and head section 90B is preferably elevated in a range between 30° to 45° from horizontal, to allow a passenger to see forward during the ride while remaining in a substantially prone position. The thrill of the ride is enhanced because the passenger is essentially lying down throughout the duration of the ride.

The rigid support 90 is upholstered throughout its interior with a bean bag body conforming chaise 92, similar in operation to the chaise 60 shown in FIG. 6, which is preferably a fabric case filled with small freely-moving particles. A pneumatic system, such as a vacuum system (not shown), is adapted to be connected to each chaise support section, 90A and 90B, at the passenger loading zone. The freely moving beads within each support section conform themselves to the passenger's body and encase the lower surface of the passenger as well as the lateral surfaces of the passenger as the passenger reclines into chaise 92. When the passenger is thus reclined and encased, a vacuum is drawn on the system to evacuate the air from the chaise to provide a rigid support precisely conforming to the passenger's body. A lap bar 94 is then applied across the thighs of each passenger and U-shaped upper support restraints 95 lie across the shoulders, chest and stomach of the passenger.

The chassis provides receptacles 96 for the lower legs of each passenger and a step 97 is mounted within the chassis 74 to allow the upper passengers to enter their seats.

Once the passenger is securely lodged in the cart as shown, the passenger cannot be thrown from the cart, nor can the passenger be bounced about within the cart with the potential of losing the passenger. The thus-encased four passengers can be taken on a ride throughout the roller coaster system with more twists, sharper turns, greater acceleration than has heretofore been possible. Additionally, due to the tiering of the body supports 90 as shown in FIG. 7, the capacity of the ride can be increased because the passenger capacity within each chassis 74 is increased. This may allow a ride capacity rate of up to 1500 passengers per hour, and maybe up to 2000 passengers per hour.

In the operation of the invention, the cars 10 are at the starting point at the lower end of the helical power section 12. The passengers are reclined onto the chaise-type body supports 46 or 92 with the body supports sufficiently vacuumed to match the contours of the passenger's body 55. The restraints are then securely applied.

The power section 12 is illustrated as being in a helical path so that the passengers can remain more or less horizontal as they rise to the top rather than have the feeling that they are standing on their heads on their way to the top of the power section 12. The power section 12 employs an endless chain having links adapted to swivel in all planes so as to conform to the helical path of the power section 12. Cogs projecting from the chain, as is conventional, engage the cars and carry them to the peak of the roller coaster. The cars are released from the cogs and move forward by their own momentum over the peak 13 and onto the vertical section of the track 14. There, because the drop is vertical, there is only a de minimis frictional force resisting the drop. In 300 feet of drop, the car will attain a speed of almost 100 miles per hour.

The car then passes underground 15 through the U-shaped section in order to convert the downward motion to upward motion. As the cars rush out of the ground, they move through a tight helical path 16 having at least three convolutions. That path could be formed in two sections. In the first section, the car rides essentially on the inside of the helix. The track is then twisted to bring the car to the outside of the section and the final helical pass is with the car on the outside of the helix, tending to give the passenger the feeling that if he is not restrained, he will fly into space.

In the wipe section 17, the track is configurated to pass up and down, left and right, as though on the inside of a semicylinder, giving the passenger the feeling of wiping back and forth.

In the final illustrated section, the track 11 is longitudinally configurated to define a tight helix so that as the car moves in a forward direction, it rolls over and over (at least three revolutions) to define a helical path. The longitudinal axis of the helical path is, in its turn, formed in a large helical path (much like a helical telephone cord), thereby imparting to the passenger a series of compound motions.

All of these motions are made possible principally by the maintaining of the occupant 55 in a substantially horizontal position that is parallel to the longitudinal axis of the tracks 11, and, secondly, by supporting the car 10 with its center of gravity below the tracks 11 when it is in a horizontal attitude while the passenger's center of gravity is slightly above the tracks 11. Additionally, greater speeds and more thrilling maneuvers are achievable with the roller coaster of the present invention, because the conforming body support holds a passenger rigidly in his seat and prevent him from slamming around the inside of the car.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. A roller coaster comprising:

an endless track, said track having a torturous section including at least one of a vertical helical section, a substantially vertical straight section, a horizontal helical section and a loop section to excite and thrill a rider;

at least one car; and means for supporting the car on the track so that said car can move through said torturous section, said car comprising:

a chassis;

body support means mounted on said chassis for supporting a human body, said body support means including body conforming means comprising:

an airtight pliable bag;

a quantity of beads contained inside said bag;

means for allowing air into the bag to allow the beads to move freely around each other and conform to the contours of the body of a passenger sitting in said body conforming means;

means for evacuating air from the bag to inhibit motion of the beads int he bas and freeze the bag into a rigid pre-evacuation passenger contour which substantially matches the body contour of said passenger and aids in securing said passenger in the car so that when the car moves through said torturous section at high speeds, the passenger in the body conforming means is not thrown around the car and enjoys the ride,

2. The roller coaster of claim 1, the body support means further including:

a lower torso support section substantially parallel to the plane of the track at the point of connection of the car to the track for maintaining the passenger's legs and torso below the waist essentially parallel with the track; and an upper torso support section elevated at an angle up to approximately 45° above the plane of said track for maintaining the passenger's torso above the waist above the plane of said track whereby when a passenger is secured in said body conforming means to ride the roller coaster, said passenger is maintained in a substantially prone position to increase the thrill of the ride through said torturous section.

3. A roller coaster comprising:

an endless track, said track having a torturous section including at least one of a vertical helical section, a substantially vertical straight section, a horizontal helical section and a loop section to excite and thrill a rider, and said endless track further comprising:

a lower rail means to support the car from below, and an upper rail means to support the car from above;

at least one car; and means for supporting the car on the track so that said car can move through said torturous section, said means for supporting the car on the track comprising:

car lower support means formed within the bottom of the car and slidably connected to the lower rail means to support and guide the car along the lower rail; and car upper support means connected to and projecting vertically upward from the car to the upper rail means, said upper support means including a post connected to said car at its lower end and slidably connected to the upper rail means at the post upper end so that when the car moves through said tortuous section, the post follows the upper rail means and rotates the car around the lower rail means.

4. The roller coaster of claim 3, the car upper support means further including rolling means connected to the upper end of the post which contact said upper rail means so the post can slide along the rail means;

the car lower support means including a channel formed in the bottom of the car parallel with the lower rail means and rolling means connected in the channel which contact said lower rail means so that the car can slide along the lower rail means.

5. The roller coaster of claim 4, the rolling means being wheel-shaped rollers.

6. The roller coaster of claim 4, the upper rail means comprising:

two parallel spaced rails, the upper end of said post including a U-shaped receptacle which partially surrounds said two parallel rails;

the upper rolling means mounted in said receptacle to engage said parallel rails to support and guide the car along the parallel rails.

7. A roller coaster comprising:

an endless track, at least one car, means for supporting the car on the track, the car comprising:

a chassis having a plurality of levels vertically spaced from each other, each of the levels including at least one body support means mounted thereon wherein a portion of the body support means on one level overlies a portion of said body support means on another level so that multiple passengers are supported above one another in a tiered manner within a single car chassis wherein one of the body support means on one of said levels is located substantially in the center of the car, and a second one of the body support means on another of said levels is located substantially on the sides of the car, so that the passengers on said another one of said levels can see forward during the ride.

8. The roller coaster of claim 7, the plurality of levels including:

an upper level, the upper level including at least one individual parallel spaced body support means, and a lower level, the lower level including at least one individual parallel spaced body support means located below and substantially rearward of the upper level body support means.

9. The roller coaster of claim 7, wherein said endless track has a torturous section including at least one of a vertical helical section, a substantially vertical straight section, a horizontal helical section and a loop section to excite and thrill a rider and wherein the body support means includes body conforming means comprising:

an airtight pliable bag, a quantity of beads contained inside said bag, means for allowing air into the bag to allow the beads to move freely around each other and conform to the contours of the body of a passenger sitting in said body conforming means, means for evacuating air from the bag to inhibit motion of the beads in the bag and freeze the bag into a rigid pre-evacuation passenger contour which substantially matches the body contour of said passenger and aids in securing said passenger in the car so that when the car moves through said torturous section, at high speeds, the passenger in the body conforming means is not thrown around the car and enjoys the ride.

10. The roller coaster of claim 9, the body support means further including:

a lower torso support section substantially parallel t the plane of the track at the point of connection of the car to the track for maintaining the passenger's legs and torso below the waist essentially parallel with the track; and an upper torso support section elevated at an angle up to approximately 45° above the plane of said track for maintaining the passenger's torso above the waist above the plane to said track whereby when a passenger is secured in said body conforming means to ride the roller coaster, said passenger is maintained in a substantially prone position to increase the thrill of the ride through said torturous section.

11. A roller coaster car for placement on an endless roller coaster track having a torturous section including at least one of a vertical helical section, a substantially vertical straight section, a horizontal helical section and a loop section to excite and thrill a rider; said car comprising:

a chassis;

body support means mounted on said chassis for supporting a human body, said body support means including body conforming means comprising:

an airtight pliable bag;

a quantity of beads contained inside said bag;

means for allowing air into the bag to allow the beads to move freely around each other and conform to the contours of of a passenger sitting in said body conforming means;

means for evacuating air from the bag to inhibit motion of the beads in the bag and freeze the bag into a rigid pre-evacuation passenger contour which substantially matches the body contour of said passenger and aids in securing said passenger in the car so that when the car moves through said torturous sections, at high speeds, the passenger in the body conforming means is not thrown around the car and enjoys the ride.

12. The roller coaster car of claim 11, the body support means further including:

a lower torso support section substantially parallel to the plane of the track at the point of connection of the car to the track for maintaining the passenger's legs and torso below the waist essentially parallel with the track; and an upper torso support section elevated at an angle up to approximately 45° above the plane of said track for maintaining the passenger's torso above the waist above the plane of said track whereby when a passenger is secured in said body conforming means to ride the roller coaster, said passenger is maintained in a substantially prone position to increase the thrill of the ride through said torturous section.

13. The roller coaster car of claim 11, the chassis having a plurality of levels vertically spaced from each other, each of the levels including at least one body support means mounted thereon wherein a portion of the body support means on one level overlies a portion of said body support means on another level so that multiple passengers are supported above one another in a tiered manner within a single car chassis.

14. The roller coaster car of claim 13, the plurality of levels including:

an upper level, the upper level including one or more individual parallel spaced body support means, and a lower level, the lower level including one or more individual parallel spaced body support means located below and substantially rearward of the upper level body support means.

15. The roller coaster car of claim 14, wherein the body support means on said upper level are located adjacent to each other substantially in the center of the car, and the body support means on said lower level are located substantially on the sides of said cars so that the passengers on the lower levels can see forward during the ride.

* * * * *

UNITED STATES PATENT AND TRADEMARK OFFICE

CERTIFICATE OF CORRECTION

PATENT NO. : 5,218,910

DATED : June 15, 1993

INVENTOR(S) : Milton E. Parrish, Ethan J. Messmer and Matthew S. Gray

It is certified that error appears in the above-indentified patent and that said Letters Patent is hereby corrected as shown below:

Column 6, line 44, "int he bas" should read --in the bag--

Column 6, line 51, "ride," should read --ride.--

Column 8, line 28, "parallel t" should read --parallel to--

Column 8, line 36, "to" should read --of--.

Column 8, line 56, "contours of of a" should read --contours of the body of a --.

Signed and Sealed this

Fifth Day of April, 1994

Bruce Lehman

BRUCE LEHMAN

*Commissioner of Patents and Trademarks*

*Attest:*

*Attesting Officer*